United States Patent [19]

Parker

[11] 4,397,123

[45] Aug. 9, 1983

[54] DRYWALL BOARD CONSTRUCTION

[76] Inventor: Robert F. Parker, Rt. 5, Box 350, Wilmington, N.C. 28401

[21] Appl. No.: 229,312

[22] Filed: Jan. 29, 1981

[51] Int. Cl.[3] ..... E04C 1/36

[52] U.S. Cl. ..... 52/100

[58] Field of Search ..... 52/98, 417, 418, 420, 52/534, 100; 428/33, 53, 34, 55, 60, 61, 763

[56] References Cited

U.S. PATENT DOCUMENTS

| | | | |
|---|---|---|---|
| 1,672,099 | 6/1928 | Schumacher | 52/361 |
| 2,305,247 | 12/1942 | Fisher | 52/417 |
| 2,314,523 | 3/1943 | Speer | 52/417 |
| 3,576,091 | 4/1971 | Shull | 52/417 |
| 4,237,669 | 12/1980 | Hunter | 52/417 |

FOREIGN PATENT DOCUMENTS

| | | | |
|---|---|---|---|
| 1287947 | 2/1962 | France | 52/417 |
| 429084 | 6/1935 | United Kingdom . | |

*Primary Examiner*—Reinaldo P. Machado

*Assistant Examiner*—Alvin Chin-Shue

*Attorney, Agent, or Firm*—B. B. Olive

[57] ABSTRACT

An improved construction for a horizontally installed drywall board incorporates widthwise extending tear-off strips on the back side of each butt end. When the butt ends of two boards are mated for nailing to a stud, the strips are removed which allows the butt ends to bend at the join line to form a depression for receiving the finishing joint cement. A pair of relatively short lengthwise extending tapered tear strips are also provided on opposite corners adjacent one edge of the board and which are also removed to facilitate continuation of the depression along the join line when the board edges are nailed to a stud plate adjacent the ceiling or floor of the room being covered by the wallboard. An alternative embodiment utilizes a tapered construction on the butt ends on the back face of the board and a convention tapered construction on the outer face of the board along its long edges.

5 Claims, 18 Drawing Figures

FIG. 3
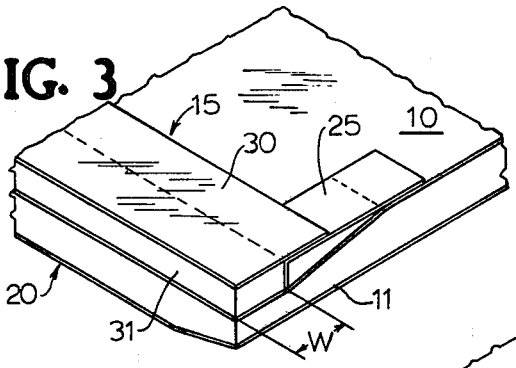
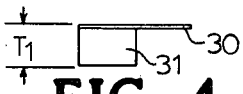
FIG. 4
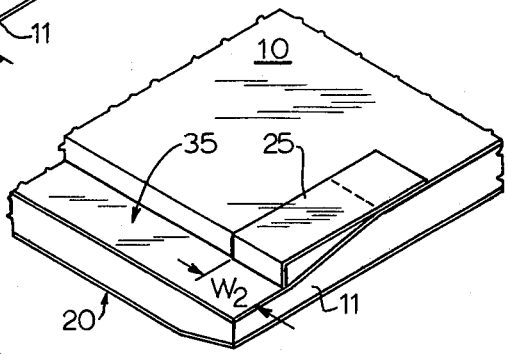
FIG. 5
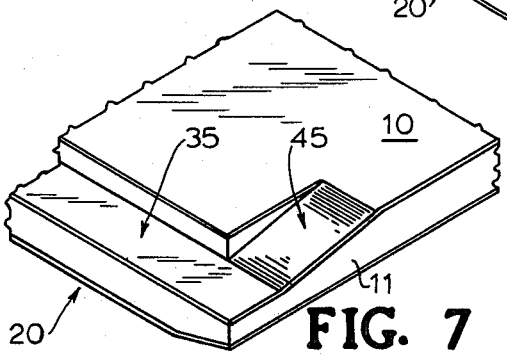
FIG. 7
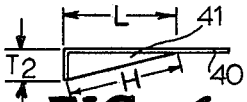
FIG. 6
FIG. 8
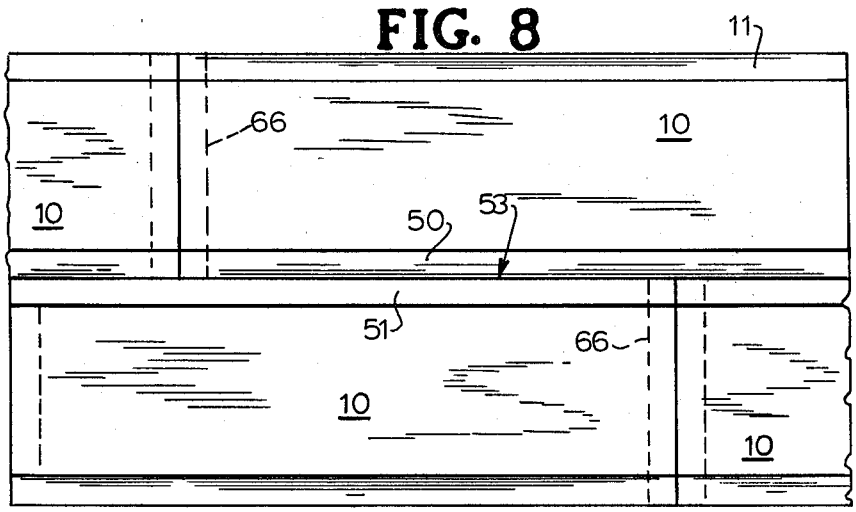

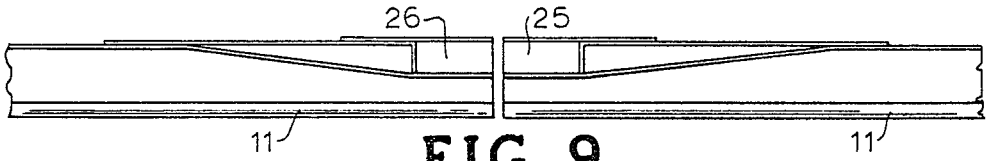
FIG. 9
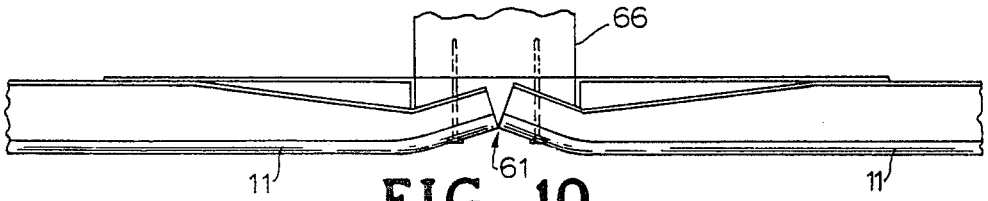
FIG. 10
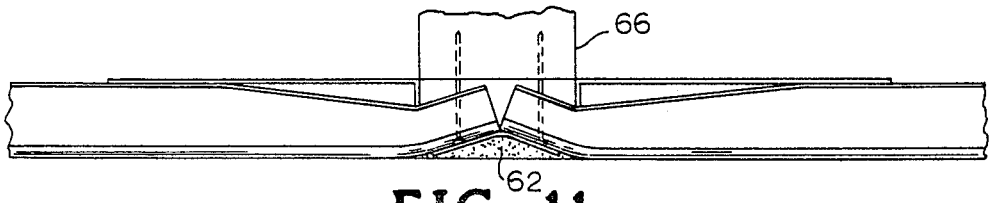
FIG. 11
FIG. 12
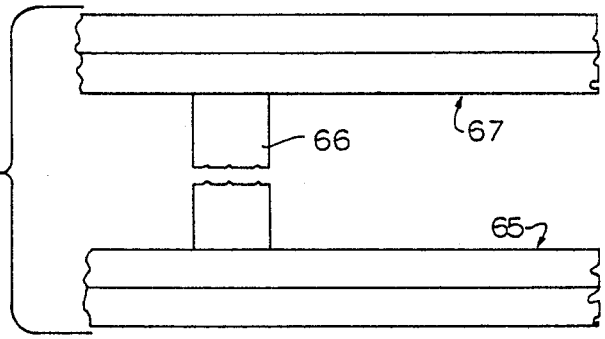
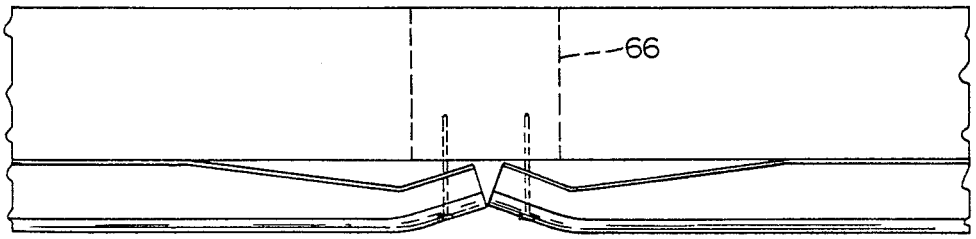
FIG. 13

DRYWALL BOARD CONSTRUCTION

DESCRIPTION

1. Technical Field

The invention relates to drywall board construction and particularly to a modified edge construction of the board on the butt ends which allows more efficient application and finishing of the cement along the vertical join lines.

2. Background Art

Drywall board is conventionally installed horizontally and vertical joints are formed by mating nontapered butt ends and securing the mated butt ends to a vertical stud. However, the long edges of the board are conventionally tapered on the outer face and horizontal joints are formed by mating the tapered edge of one board to the tapered edge of another board. The tapered edges running lengthwise of the board when placed in abutting relation form a shallow depression along the horizontal join line which facilitates obtaining a flat, neat appearing seam when the tape and finishing cement are applied. However, since the butt ends are not tapered, the vertical seams essentially require building up a mound of cement along each vertical join and the obtaining of a satisfactory appearance in the vertical joins is thus more difficult. Also, more time and finishing cement is often required per unit length of vertical joint than is required per unit length of horizontal joint.

At least some butt ends of drywall boards used on a job will, of course, be fitted and hidden in corners while other drywall board butt ends will be used to form vertical joints. Another practical consideration is that on every job some drywall board will be installed adjacent the ceiling or floor and in addition to being nailed to studs will be nailed to plate members above or below the studs.

With the foregoing in mind, it can be seen that it would be desirable to have a drywall board construction with the butt ends of the boards adapted to being installed either in corners where uniform board thickness is desirable or abutted along vertical join lines and in a manner enabling a vertical extending depression to be formed along each vertical join line including join lines extending to the ceiling or floor so as to enhance the final cement filling and finishing operation along each of the vertical joints.

The prior art recognizes the described problem and in British Pat. No. 429,084, accepted May 23, 1935, as well as in U.S. Pat. No. 3,576,091, there is taught the practice of using tapered edges on the outer faces of drywall boards on the butt ends which are abutted to form vertical joints. U.S. Pat. No. 2,314,523 also deals with the vertical seam problem and teaches providing a recess on the outer face of each butt end to facilitate finishing of vertical joints. However, in applicant's experience, neither the tapered edge on the outer face of each butt end or the presence of a recess on the outer face of each butt end has found acceptance in the trade presumably because the presence of a tapered edge or a recess on a butt end of a board being used to form a corner is undesirable.

The object of the present invention thus becomes that of providing a board construction in which the board butt ends can be either utilized as butt ends of uniform thickness for forming corners or can have portions removed so that when the butt ends are used to form vertical joints a recess can be provided to facilitate the final cement finishing operation over the vertical join lines. Alternatively, the back faces of the butt ends can be tapered.

DISCLOSURE OF INVENTION

A drywall board according to the invention is formed with tapered edges on the outer face of the long lengthwise extending edges of the board. The butt ends of the board are provided with widthwise extending tear-off strips on the back face of the board. In addition, a pair of relatively short lengthwise extending tapered tear strips are provided on opposite corners of the back face of at least one long edge of the board and within the boundaries of the tear strips. When the modified butt end of the board construction of the invention is used in a corner joint, the tear strips are left in place and the board butt end displays its conventional uniform thickness along the butt end. However, when the butt ends of a pair of the modified boards of the invention are intended to be mated along an exposed vertical join line, the widthwise running tear strips are removed from the respective back faces of the mated boards before nailing to allow the forming of an outer, shallow depression along each vertical join line for receiving the finishing cement. Further, whenever a pair of the modified boards of the invention are to be abutted adjacent the floor or ceiling of the room being covered, the short tapered tear strips of the abutted board butt ends are also removed before nailing the boards to the studs and stud ceiling or floor plates to insure continuation of the desired depression to the ceiling or floor as the case may be.

In summary, the modified board construction of the invention provides a drywall board with butt ends which can be installed either with normal uniform thickness as conventionally applied in corner constructions or, by removing the appropriate tear strips on the butt ends, can be applied to form vertical join lines with a vertical depression along each vertical join line including vertical join lines adjacent the floor or ceiling, to facilitate receiving and finishing of the joint cement. Alternatively, the back faces of the butt ends can be tapered.

DESCRIPTION OF THE DRAWINGS

FIG. 3 is a partial perspective view of a typical butt end corner of a drywall board modified according to the invention.

FIG. 4 is a cross sectional view of the widthwise butt end tear strip used in the board construction of the invention.

FIG. 5 illustrates the butt end corner shown in FIG. 3 as it appears with the widthwise tear strip removed.

FIG. 6 is a cross-sectional view of the tapered tear strip illustrated in FIG. 5.

FIG. 7 illustrates the butt end corner of FIG. 3 with both the widthwise tear strip as well as the tapered tear strip removed.

FIG. 8 is an elevation view showing the outer face of portions of several drywall boards of the invention as they are intended to be installed to form horizontal and vertical joints to be finished with tape and cement.

FIG. 9 is a plan view taken generally in the direction of line 9—9 of FIG. 8 illustrating a pair of the modified board butt ends of the invention as they are typically positioned before removal of the tear strips.

FIG. 10 is a view similar to FIG. 9 illustrating the pair of modified butt ends of the invention with the widthwise tear strips removed, with the tapered tear strips in place and with the butt ends nailed in place to form a depression for receiving the finishing cement along the vertical join line.

FIG. 11 is similar to FIG. 10 but showing the finishing cement applied to the vertical depression along the vertical join line.

FIG. 12 illustrates the type of ceiling and floor framing construction to which drywall boards are typically secured at the floor and ceiling.

FIG. 13 is a top plan view of two modified butt ends of the invention as they appear with both sets of tear strips removed and with the butt ends nailed to the ceiling plate members enabling the vertical depression along the join line to extend to the ceiling.

BEST MODE FOR CARRYING OUT THE INVENTION

Figures 1, 2:
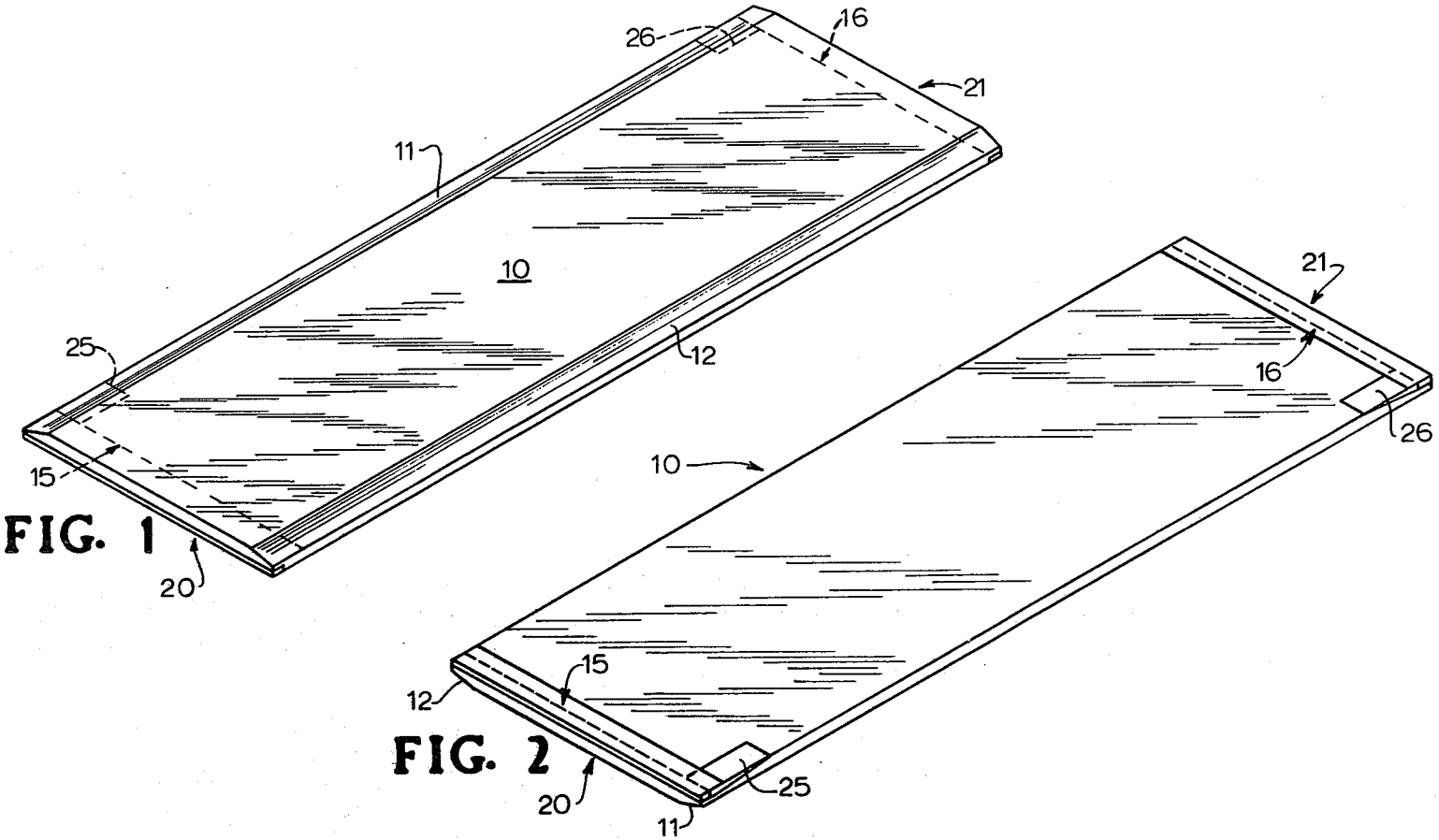
FIG. 1 is a perspective view of the front face of a drywall board modified according to the invention.
FIG. 2 is a perspective view of the back face of the modified drywall board of the invention.
Figure 14:
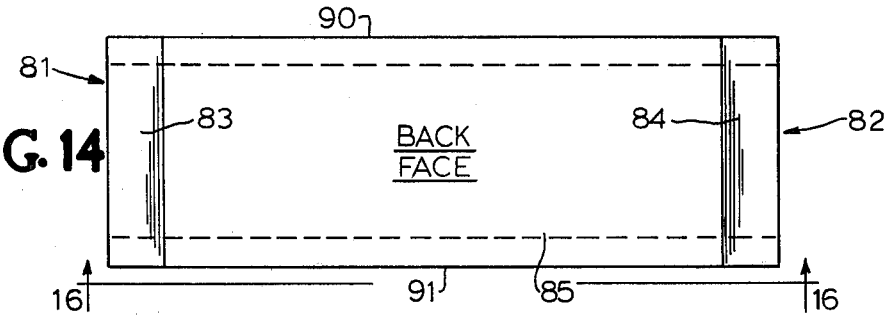
FIG. 14 is a plan view of the back face of a drywall board according to a second embodiment.
Figure 15:
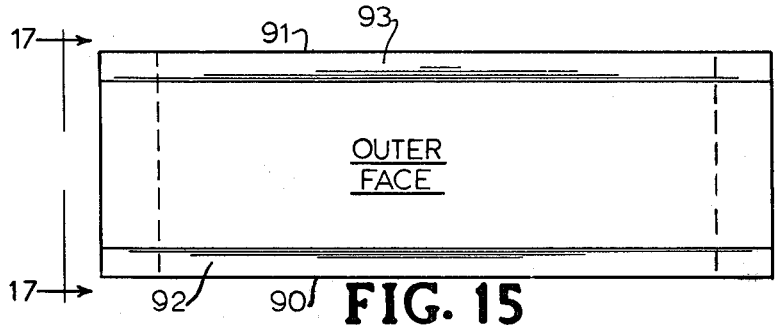
FIG. 15 is a plan view of the outer face of a drywall board according to the second embodiment.
Figure 16:
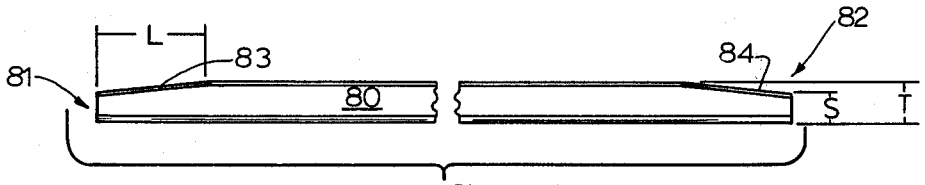
FIG. 16 is an elevation view taken in the direction of line 16—16 of FIG. 15.
Figure 17:
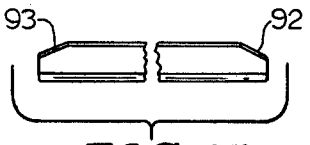
FIG. 17 is an end view taken in the direction of line 17—17 in FIG. 15.

Referring to the drawings, FIG. 1 illustrates in a first preferred embodiment a perspective view of the front face of a drywall board 10 modified according to the invention. Board 10 includes conventional beveled edges 11, 12 running lengthwise and on the front face of the board. Beveled edges 11, 12 facilitate the finishing of horizontal joints or seam lines by providing a shallow cement receiving recess along each horizontal join line for receiving the finishing cement and tape according to conventional practices.

FIG. 2 is a perspective view of the back side of the board 10 modified according to the invention so as to have a pair of widthwise tear-off strips 15, 16 on the respective butt ends 20, 21. The modified board 10 also includes another pair of short tapered tear-off strips 25, 26 on the back face of board 10 within the boundaries of tear-off strips 15, 16 and extending lengthwise along tapered edge 11. While economic considerations would dictate the employment of only a pair of the short tapered tear-off strips 25, 26, the invention contemplates that four such short tapered tear-off strips, one at each butt end corner, could be employed, if desired.

Referring next to FIGS. 3–5 and using tear strips 15 and 25 by way of example, it would be noted that the widthwise tear strip 15 is made up of a tear-off paper strip 30 wrapped over a drywall board core material 31. Strip 30 is glued to the back face paper liner of board 10 and core material 31 of width W (FIG. 3) and thickness $T_1$ is shaped such that strip 15 before removal substantially fills in the notch space 35 running widthwise of board 10 on each butt end. Thus, when the widthwise tear-off strips 15, 16 are in place, the respective butt ends 20, 21 exhibit their normal substantially uniform thickness characteristic. However, when strips 15, 16 are torn off and removed, each butt end of board 10 is provided on the back face with the indicated notch 35 which enables a vertical cement receiving recess to be formed along each vertical join line as later described. As previously mentioned, modified board 10 also includes a pair of short tapered tear-off strips 25, 26 with strip 25 being shown and described by way of example in reference to FIGS. 3–7. Strip 25 is triangular in cross section as depicted in FIG. 6 and is formed of paper cover 40 glued to the back face paper liner of board 10 and surrounds drywall board core material 41. Dimensions $W_2$, $T_2$, H and L are selected such that strip 25 substantially fills tapered notch 45 in place prior to being torn off. As later explained, the short tapered strips 25 and 26 are only removed when the board 10 is employed adjacent a floor or ceiling such that tapered edge 11 is positioned for nailing against floor or plate members as shown in the typical framing construction illustrated in FIG. 12.

Simply by way of example, the invention has been applied to drywall board of one-half inch thickness and in this application the dimension W of tear strip 15 was two and one-half inches and the dimension T was three-sixteenths inch. In the same application, the dimensions $W_2$, $T_2$, H and L of tear strip 25 were respectively four inches, three-sixteenths inch, two and nine-sixteenths inches, and two and one-half inches.

Drywall board is typically positioned horizontally as depicted in FIG. 8 with the beveled outer side edges on the outer face of adjoining boards, such as edges 50, 51 being abutted to form shallow lengthwise running recesses along each horizontal joint 52 for receiving the finish cement coating and tape according to conventional practices. Also, the drywall boards are typically secured to vertical studs at the vertical join lines and are furthermore secured to the top and bottom structural plates at the ceiling and floor with FIG. 12 illustrating typical construction framing for this purpose. In this regard, it should be noted that the modified board construction of the present invention is primarily concerned with the board construction which facilitates the forming of the vertical joints and seams as distinct from the board construction relating to forming the horizontal joints and seams which may be of conventional practice.

In making up vertical joints and seams using the modified board 10 of the invention, the modified butt ends of two boards to be mated have their respective tear strips, such as tear strips 15 or 16, removed after which they are positioned and nailed to a stud 66 at the join as, for example, on sixteen inch centers. Thus, when a pair of the illustrated abutting widthwise tear strips are removed and the back faces of adjoining board butt ends are nailed to a stud 66 as in FIG. 10, a vertical extending recess is provided for filling with cement 60 as seen in FIG. 11. That is, by removing the respective tear strips, the mated abutting butt ends are made somewhat thinner than normal and thus are enabled to effectively bend and form a vertical extending recess such as recess 61 for receiving the finish cement 62 and tape.

When the boards 10 of the invention are installed at some position intermediate the ceiling and floor as illustrated in FIG. 8, only the widthwise tear strips will be removed at the vertical join lines formed on the respective studs 66. However, when the boards 10 are installed adjacent either the ceiling or the floor and are required to be nailed either to floor plates 65 or ceiling plates 67, it is necessary that the respective boards 10 be positioned so that a pair of the short tapered tear-off strips can be removed at the end of the vertical join line at the floor or the ceiling as the case may be to insure that the mentioned vertical cement receiving recess extends fully to the ceiling of the floor, depending on where the board 10 is being installed.

Thus, when drywall board 10 is installed and is required to be nailed in place, either at the floor or at the ceiling against outer surfaces of either floor plates 65 or ceiling plates 67, the appropriate short tapered tear-off strips are removed, such as tapered strips 25, 26, enabling a ceiling joint to be formed as illustrated in FIG. 13.

A particular advantage of the invention resides in the fact that it now becomes possible to form vertical seams without having to mound the finishing cement over flat surfaces as in past drywall board constructions. Furthermore, it will be seen that the modified board construction of the invention readily adapts to bowed-out studs, misaligned walls, twisted studs, and like situations encountered in actual practical construction. Also, the vertical seams can be finished with a single trowel operation rather than with a double trowel operation. Additionally, it has been discovered that substantially less finishing cement and substantially less sanding operations are required and a more uniform, smooth and level surface effect is produced.

FIGS. 15–18 illustrate a second embodiment drywall board 80 having butt ends 81, 82 with tapered surfaces 83, 84 on the back face 85 of the board and with the long edges 90, 91 of the board having conventional tapered surfaces 92, 93 on the outer face of the board.

Figure 18:
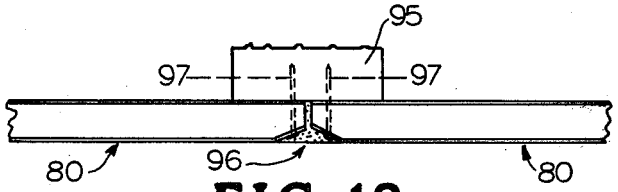
FIG. 18 is similar to FIG. 11 illustrating how the board of the second embodiment is applied to a stud.

In use, the alternate board 80 is adapted to have the butt ends bent when nailed to a study 95 with nails 97, as illustrated in FIG. 18, for creating a depression 96 in which the finish coating can be applied as previously explained. As an example, the alternate board 80 had a thickness T of $\frac{1}{2}''$, a taper length L of 12", and a slope dimension S of $\frac{1}{8}''$. The tapered surfaces 92, 93 on the long edges 90, 91 on the outer face were conventionally dimensioned. With such dimensions, the butt ends 81, 82 were easily bent as desired when nailed as seen in FIG. 18.

What is claimed is:

1. A drywall panel board of rectangular shape formed of paper wrapped core material and having front and back faces defined by long and short edges, said edges being characterized by the long edges being tapered on the front face marginal portions thereof enabling pairs of boards of such construction to be secured with the front faces exposed and with one long edge of each abutted together to form an inwardly tapered recess along the join line of the abutted long edges suitable for receiving finishing material therein, and with the short edges having bendable marginal portions throughout the length and on the back face thereof, said marginal portion of each said short edge including a first removable rectangular strip on the back face of the board and formed of paper wrapped core material with a tear strip secured thereto and to the body of said board enabling other pairs of boards of such construction to be secured to common framing members with the front faces exposed and with one short edge of each abutted and with the marginal portions of each such abutted short edge secured and with said rectangular strips removed to allow inward bending whereby to form an inwardly tapered recess along the join line of the abutted short edges also suitable for receiving finishing material therein.

2. A drywall panel board as claimed in claim 1 wherein said marginal portion of each said short edge includes at least one additional second removable strip extending from a said first strip lengthwise of the board and adjacent a long edge.

3. A drywall panel board of rectangular shape formed of paper wrapped core material and having front and back faces defined by long and short edges, said edges being characterized by the long edges being tapered inwardly on the front face marginal portions thereof enabling pairs of boards of such construction to be secured to framing members with the front faces exposed and with one long edge of each abutted together to form an inwardly tapered recess along the join line of the abutted long edges suitable for receiving finishing material therein, and with the short edges having defined marginal portions on the back face thereof, said short edge marginal portions being formed on the back face in a manner enabling a thickness less than the normal board thickness to be obtained throughout the length of each said short edge such that the opposing front face marginal portions along said short edges can be bent inwardly thereby further enabling the short edges of other pairs of boards of similar construction to be secured to said framing members with the front faces exposed and with one short edge of each abutted to form an inwardly tapered recess along the join line of the abutted short edges suitable for receiving finishing material therein.

4. A drywall panel board as claimed in claim 3 wherein said short edge marginal portions include removable portions on the back face thereof enabling the front face of said marginal portions after such portions have been removed from the back face to be bent inwardly when secured to said framing members.

5. A drywall panel board as claimed in claim 3 wherein said marginal portions comprise said short edges being tapered inwardly on the back face marginal portions thereof.

* * * * *